US010563622B2

(12) United States Patent
Asanuma et al.

(10) Patent No.: US 10,563,622 B2
(45) Date of Patent: Feb. 18, 2020

(54) EVAPORATED FUEL PROCESSING DEVICE

(71) Applicant: AISAN KOGYO KABUSHIKI KAISHA, Obu-shi (JP)

(72) Inventors: Daisaku Asanuma, Gamagori (JP); Nobuhiro Kato, Tokai (JP)

(73) Assignee: AISAN KOGYO KABUSHIKI KAISHA, Obu-Shi (JP)

( * ) Notice: Subject to any disclaimer, the term of this patent is extended or adjusted under 35 U.S.C. 154(b) by 0 days.

(21) Appl. No.: 16/088,297

(22) PCT Filed: Feb. 2, 2017

(86) PCT No.: PCT/JP2017/007395

§ 371 (c)(1),
(2) Date: Sep. 25, 2018

(87) PCT Pub. No.: WO2017/169423

PCT Pub. Date: Oct. 5, 2017

(65) Prior Publication Data

US 2019/0101082 A1 Apr. 4, 2019

(30) Foreign Application Priority Data

Mar. 30, 2016 (JP) ..... 2016-069340

(51) Int. Cl.
*F02M 25/08* (2006.01)

(52) U.S. Cl.
CPC ..... *F02M 25/0836* (2013.01); *F02M 25/08* (2013.01); *F02M 25/089* (2013.01); *F02M 2025/0845* (2013.01)

(58) Field of Classification Search
CPC .. F02M 25/08; F02M 25/089; F02M 25/0836; F02M 2025/0845

(Continued)

(56) References Cited

U.S. PATENT DOCUMENTS 5,363,832 A 11/1994 Suzumura et al.
6,695,895 B2 2/2004 Hyodo et al.

FOREIGN PATENT DOCUMENTS

JP H5-321772 A 12/1993
JP H6-101534 A 4/1994

(Continued)

OTHER PUBLICATIONS

Written Opinion of the International Searching Authority of PCT International App. No. PCT/JP2017/007395 dated May 9, 2017 with English Translation (6 pages).

(Continued)

*Primary Examiner* — Hai H Huynh
(74) *Attorney, Agent, or Firm* — Shumaker, Loop & Kendrick, LLP

(57) ABSTRACT

An evaporated fuel processing device including a purge passage through which a purge gas sent from a canister to an intake passage passes, a pump sending the purge gas to the intake passage, a control valve switching between a communication state and a cutoff state, a branch passage branching from the purge passage at an upstream end and joining the purge passage at a downstream end, a pressure specifying unit comprising a small diameter portion disposed on the branch passage, and specifying a pressure difference of the purge gas passing through the small diameter portion between an upstream side and a downstream side, and an estimation unit estimating a flow rate of the purge gas sent from the pump by using an evaporated fuel concentration in the purge gas that is estimated using an air-fuel ratio and the pressure difference.

4 Claims, 11 Drawing Sheets

(58) Field of Classification Search
USPC ..... 123/516, 518, 519, 520; 701/103
See application file for complete search history.

(56) References Cited

FOREIGN PATENT DOCUMENTS

| | | | |
|---|---|---|---|
| JP | 2002-332921 | A | 11/2002 |
| JP | 2007-198267 | A | 8/2007 |

OTHER PUBLICATIONS

International Search Report for PCT/JP2017/007395 dated May 9, 2017 (2 pages including English translation).

EVAPORATED FUEL PROCESSING DEVICE

TECHNICAL FIELD

The description herein discloses a technique related to an evaporated fuel processing device. Especially, it discloses an evaporated fuel processing device configured to purge evaporated fuel generated in a fuel tank to an intake passage and process the same.

BACKGROUND

JP H6-101534 A describes an evaporated fuel processing device. The evaporated fuel processing device executes a purge process of adsorbing evaporated fuel in a fuel tank using a canister and supplying the evaporated fuel in the canister to an intake passage of an engine. In the purge process, a pump is used to supply a purge gas containing the evaporated fuel from the canister to the intake passage.

SUMMARY

Technical Problem

In the above technique, a flow rate of the purge gas sent out by the pump is specified based on a rotary speed of the pump. The flow rate of the purge gas changes depending on an individual difference regarding pump performance (for example, dimensional differences in a purge gas passage area in the pump), however, this is not taken into consideration in the above technique. Further, when a density of the purge gas changes due to a concentration of the evaporated fuel in the purge gas (hereinbelow termed "gas concentration"), the flow rate of the purge gas relative to the rotary speed of the pump changes. Due to this, there are situations where it is difficult to suitably estimate the flow rate of the purge gas by the mere use of the rotary speed of the pump. The description herein takes the above circumstance into consideration, and provides a technique that estimates a flow rate of a purge gas sent by a pump.

Solution to Problem

The technique disclosed herein is related to an evaporated fuel processing device mounted on a vehicle. The evaporated fuel processing device may comprise: a canister configured to adsorb fuel evaporated in a fuel tank; a purge passage connected between the canister and an intake passage of an engine, and through which a purge gas sent from the canister to the intake passage passes; a pump configured to send the purge gas from the canister to the intake passage; a control valve disposed on the purge passage and configured to switch between a communication state and a cutoff state, the communication state being a state where the canister and the intake passage communicate through the purge passage, and the cutoff state being a state where the canister and the intake passage are cut off on the purge passage; a branch passage branching from the purge passage at an upstream end of the branch passage and joining the purge passage at a downstream end of the branch passage, the downstream end of the branch passage being located at different position from the upstream end of the branch passage; a pressure specifying unit comprising a small diameter portion disposed oil the branch passage and through which the purge gas in the branch passage passes, and configured to specify a pressure difference of the purge gas passing through the small diameter portion between an upstream side and a downstream side of the small diameter portion, an air-fuel ratio sensor disposed on an exhaust passage of the engine; an estimation unit configured to estimate a first flow rate of the purge gas sent from the pump by using an evaporated fuel concentration in the purge gas that is estimated using an air-fuel ratio acquired from the air-fuel ratio sensor and the pressure difference specified by the pressure specifying unit.

A density and a viscosity of the purge gas change according to a gas concentration. The density and the viscosity of the purge gas each have a correlated relationship with a pressure difference in the purge gas between the upstream and downstream sides of the small diameter portion and the flow rate of the purge gas flowing through the small diameter portion. Due to this, the flow rate may be estimated using the gas concentration and the pressure difference of the purge gas. According to this configuration, the flow rate may be estimated by using the purge gas and the pump that are actually used. Due to this, the flow rate of the purge gas sent by the pump may be estimated by taking an individual difference in a performance of the pump and a variation in the flow rate caused by the gas concentration into consideration.

The estimation unit may be configured to estimate a second flow rate of the purge gas sent from the pump by using a rotary speed of the pump; and calculate a value related to a variation of a flow rate of the pump by using the first flow rate and the second flow rate. According to this configuration, the variation in the pump flow rate may be quantified by the value related to the variation.

The evaporated fuel processing device may further comprise: a determination unit configured to determine whether the pump operates normally or not by using the value related to the variation of the flow rate. According to this configuration, the determination on whether the pump is operating normally or not may be made by using the value related to the variation, which was quantified by using the flow rate estimated form the gas concentration and the pressure difference in the purge gas and the flow rate estimated from the rotary speed.

The estimation unit may be configured to correct the second flow rate by using the value related to the variation of the flow rate so as to estimate a corrected second flow rate of the purge gas sent from the pump. According to this configuration, the second flow rate estimated from the rotary speed may be corrected using the quantified value related to the variation. Due to this, the flow rate may suitably be estimated using the rotary speed.

DESCRIPTION OF EMBODIMENTS

First Embodiment

Figure 1:
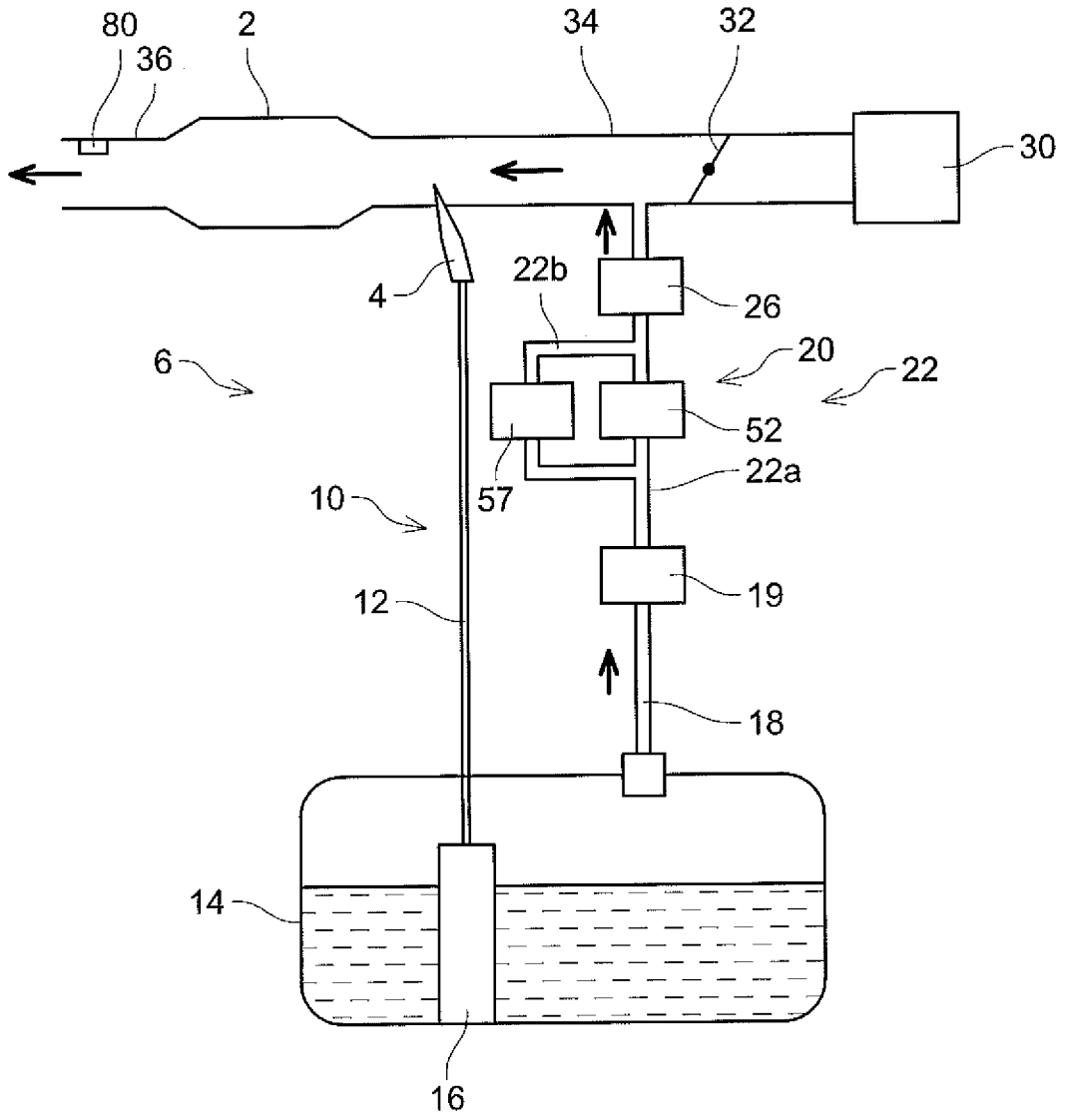
FIG. 1 shows a fuel supply system of a vehicle using an evaporated fuel processing device according to a first embodiment.

A fuel supply system 6 provided with an evaporated fuel processing device 20 will be described with reference to FIG. 1. The fuel supply system 6 is provided with a main supply passage 10 for supplying fuel stored in a fuel tank 14 to an engine 2 and a purge supply passage 22 for supplying evaporated fuel generated in the fuel tank 14 to the engine 2.

The main supply passage 10 is provided with a fuel pump unit 16, a supply passage 12, and an injector 4. The fuel pump unit 16 is provided with a fuel pump, a pressure regulator, a control circuit, and the like. The fuel pump unit 16 controls the fuel pump according to a signal supplied from an ECU 100 (see FIG. 6). The fuel pump boosts pressure of the fuel in the fuel tank 14 and discharges the same. The pressure of the fuel discharged from the fuel pump is regulated by the pressure regulator, and the fuel is supplied from the fuel pump unit 16 to the supply passage 12. The supply passage 12 is connected to the fuel pump unit 16 and the injector 4, The fuel supplied to the supply passage 12 passes through the supply passage 12 and reaches the injector 4. The injector 4 includes a valve (not shown) of which aperture is controlled by the ECU 100. When the valve of the injector 4 is opened, the fuel in the supply passage 12 is supplied to an intake passage 34 connected to the engine 2.

The intake passage 34 is connected to an air cleaner 30. The air cleaner 30 is provided with a filter that removes foreign particles in air that flows into the intake passage 34. A throttle valve 32 is provided in the intake passage 34 between the engine 2 and the air cleaner 30. When the throttle valve 32 opens, air is suctioned from the air cleaner 30 toward the engine 2. The throttle valve 32 adjusts a aperture of the intake passage 34 and adjusts a quantity of air flowing into the engine 2. The throttle valve 32 is provided on an upstream side (air cleaner 30 side) than the injector 4.

The purge supply passage 22 is provided with a purge passage 22*a* through which a purge gas passes when it moves from the canister 19 to the intake passage 34, and a branch passage 22*b* that branches from the purge passage 22*a*. The purge supply passage 22 is provided with the evaporated fuel processing device 20. The evaporated fuel processing device 20 is provided with a canister 19, a purge passage 22*a*, a pump 52, a control valve 26, a branch passage 22*b*, a concentration sensor 57, and an air-fuel ratio (hereinbelow termed A/F) sensor 80. The fuel tank 14 and the canister 19 are connected by a communicating passage 18. The canister 19, the pump 52, and the control valve 26 are disposed on the purge passage 22*a*. The purge passage 22*a* is connected to the intake passage 34 between the injector 4 and the throttle valve 32. The branch passage 22*b* has one end connected to the purge passage 22*a* on an upstream side of the pump 52, and another end connected to the purge passage 22*a* on a downstream side of the pump 52. The concentration sensor 57 is provided on the branch passage 22*b*. The control valve 26 is a solenoid valve controlled by the ECU 100, and is a valve of which switch between a communication state and a cutoff state is controlled by the ECU 100 on a duty basis. The control valve 26 adjusts a flow rate of a gas containing the evaporated fuel (that is, the purge gas) by controlling its opening and closed times (controlling a switching timing between the communication state and the cutoff state). Alternatively, the control valve 26 may be a stepping motor type control valve of which aperture can be adjusted.

Figure 2:
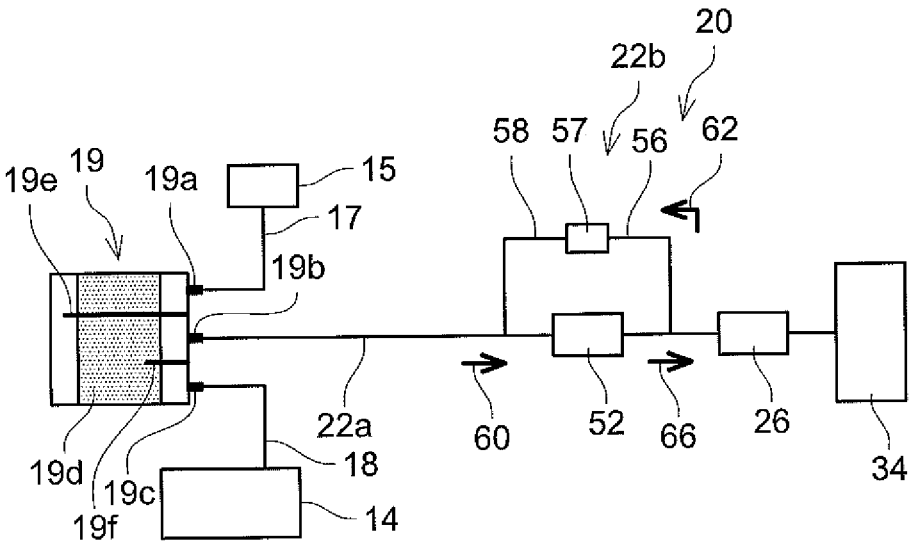
FIG. 2 shows the evaporated fuel processing device according to the first embodiment.

As shown in FIG. 2, the canister 19 is provided with an air port 19*a*, a purge port 19*b*, and a tank port 19*c*. The air port 19*a* is connected to an air filter 15 via a communicating passage 17. The purge port 19*b* is connected to the purge passage 22*a*. The tank port 19*c* is connected to the fuel tank 14 via a communicating passage 18. An activated charcoal 19*d* is accommodated in the canister 19. The ports 19*a*, 19*b*, and 19*c* are provided on one of wall surfaces of the canister 19 facing the activated charcoal 19*d*. A space exists between the activated charcoal 19*d* and the inner wall of the canister 19 on which the ports 19*a*, 19*b*, and 19*c* are provided. A first partitioning plate 19*e* and a second partitioning plate 19*f* are fixed to the inner wall of the canister 19 on a side where the ports 19*a*, 19*b*, and 19*c* are provided. The first partitioning plate 19*e* partitions the space between the activated charcoal 19*d* and the inner wall of the canister 19 in a range between the air port 19*a* and the purge port 19*b*. The first partitioning plate 19*e* extends to a space on an opposite side from the side where the ports 19*a*, 19*b*, and 19*c* are provided. The second partitioning plate 19*f* partitions the space between the activated charcoal 19*d* and the inner wall of the canister 19 in a range between the purge port 19*b* and the tank port 19*c*.

The activated charcoal 19*d* adsorbs the evaporated fuel from the gas that flows into the canister 19 from the fuel tank 14 through the communicating passage 18 and the tank port 19*c*. The gas after the evaporated fuel has been adsorbed is discharged to open air by passing through the air port 19; the communicating passage 17, and the air filter 15. The canister 19 can prevent the evaporated fuel in the fuel tank 14 from being discharged to open air. The evaporated fuel adsorbed by the activated charcoal 19*d* is supplied to the purge passage 22*a* from the purge port 19*b*. The first partitioning plate 19*e* partitions the space where the air port 19*a* is connected and the space where the purge port 19*b* is connected. The first partitioning plate 19*e* prevents the gas containing the evaporated fuel from being discharged to open air. The second partitioning plate 19*f* partitions the space where the purge port 19*b* is connected and the space where the tank port 19*c* is connected. The second partitioning plate 19*f* prevents the gas flowing into the canister 19 from the tank port 19*c* from moving directly to the purge passage 22*a*.

The purge passage 22*a* connects the canister 19 the intake passage 34. The pump 52 and the control valve 26 are provided on the purge passage 22*a*. The pump 52 is disposed between the canister 19 and the control valve 26, and pumps the purge gas to the intake passage 34. Specifically, the pump 52 draws the purge gas in the canister 19 through the purge passage 22*a* in a direction of an arrow 60, and pushes the purge gas through the purge passage 22*a* toward the intake passage 34 in a direction of an arrow 66. In a case where the engine 2 is driving, the intake passage 34 is in a negative pressure. Due to this, the evaporated fuel adsorbed in the canister 19 can be introduced to the intake passage 34 by a pressure difference between the intake passage 34 and the canister 19. However, by disposing the pump 52 on the purge passage 22*a*, the evaporated fuel adsorbed in the canister 19 can be supplied to the intake passage 34 even in cases where the pressure in the intake passage 34 is a pressure that is not sufficient for drawing the purge gas therein (such as a positive pressure in a supercharged state generated by a supercharger (not shown), or the negative pressure but with an absolute pressure value being small). Further, by disposing the pump 52, a desired quantity of the evaporated fuel can be supplied to the intake passage 34.

The purge passage 22*a* has the branch passage 22*b* connected thereto. The concentration sensor 57 is disposed on the branch passage 22*b*. More specifically, the branch passage 22*b* is provided with a first branch pipe 56 and a second branch pipe 58. One end of the first branch pipe 56 being one end of the branch passage 22*b* is connected downstream of the pump 52 (on the intake passage 34 side). One end of the second branch pipe 58 being other end of the branch passage 22*b* is connected upstream of the pump 52 (on the canister 19 side). Other ends of the first branch pipe 56 and the second branch pipe 58 are connected to the concentration sensor 57. The concentration sensor 57 specifies the concentration of the purge gas passing through the branch passage 22*b*.

In the evaporated fuel processing device 20, when the control valve 26 is opened in the state where the pump 52 is driven, the purge gas moves in the direction of the arrow 66 and is introduced into the intake passage 34. Further, when the control valve 26 is closed in the state where the pump 52 is driven, the purge gas moves in a direction of an arrow 62, and the concentration is specified in the concentration sensor 57. The concentration sensor 57 is provided on the branch passage 22*b* and not on the purge passage 22*a*. Due to this, the evaporated fuel processing device 20 is suppressed from increasing a resistance in the purge passage 22*a* and the quantity of the purge gas supplied to the intake passage 34 can be avoided from being restricted. By adjusting inner diameters of the purge passage 22*a* and the branch passage 22*b*, the purge gas can be supplied to the concentration sensor 57 while supplying the purge gas to the intake passage 34. In this case, the concentration of the purge gas supplied to the intake passage 34 can be specified on real-time basis.

Figure 3:
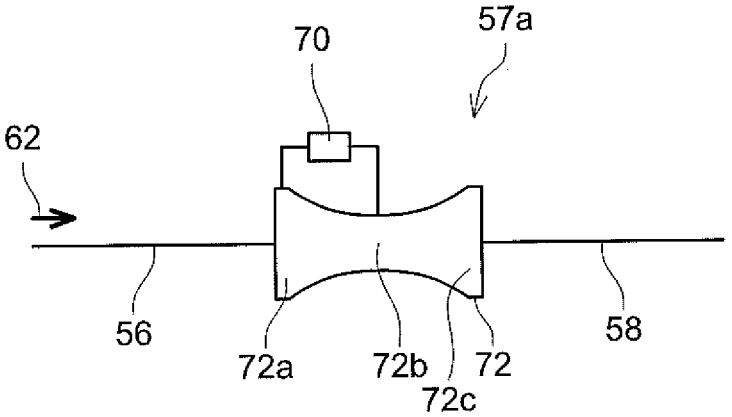
FIG. 3 shows an example of a concentration sensor.

As the concentration sensor 57, various types of sensors may be used. Here, three types of concentration sensors 57 that can be used in the evaporated fuel processing device 20 will be described with reference to FIGS. 3 to 5. FIG. 3 shows a concentration sensor 57*a* provided with a venturi pipe 72. One end 72*a* of the venturi pipe 72 is connected to the first branch pipe 56. Another end 72*c* of the venturi pipe 72 is connected to the second branch pipe 58. The differential pressure sensor 70 is connected between the end 72*a* and a center portion (small diameter portion) 72*b* of the venturi pipe. The concentration sensor 57*a* specifies a pressure difference between the end 72*a* and the center portion 72*b* using the differential pressure sensor 70. By specifying the pressure difference between the end 72*a* and the center portion 72*b*, a density of the purge gas (purge gas concentration) can be calculated using a Bernoulli formula.

Figure 4:
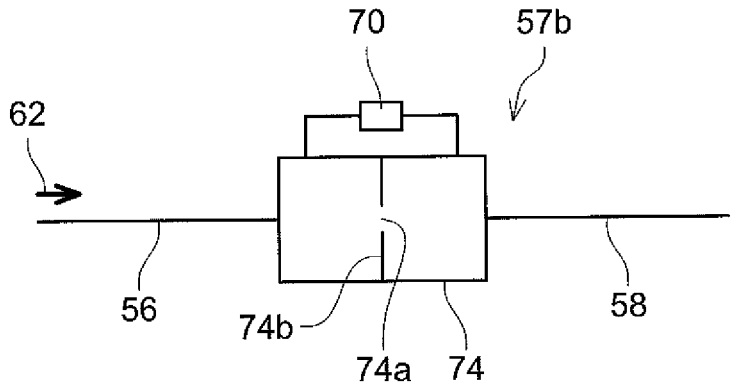
FIG. 4 shows an example of the concentration sensor.

FIG. 4 shows a concentration sensor 57*b* provided with an orifice pipe 74. One end of the orifice pipe 74 is connected to the first branch pipe 56 and another end is connected to the second branch pipe 58. An orifice plate 74*b* (small diameter portion) having an aperture 74*a* is provided at a center of the orifice pipe 74. The differential pressure sensor 70 is connected to upstream and downstream sides of the orifice plate 74*b*. The concentration sensor 57*b* specifies a pressure difference between the upstream and downstream sides of the orifice plate 74*b* using the differential pressure sensor 70, and calculates the purge gas concentration.

Figure 5:
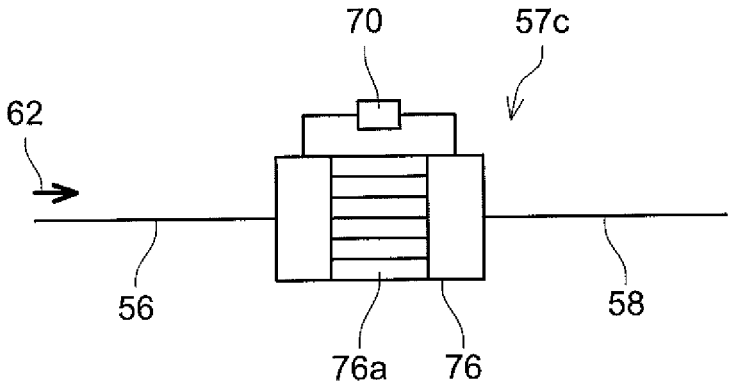
FIG. 5 shows an example of the concentration sensor.

FIG. 5 shows a concentration sensor 57*c* provided with a capillary pipe viscometer 76. One end of the capillary pipe viscometer 76 is connected to the first branch pipe 56, and another end of the capillary pipe viscometer 76 is connected to the second branch pipe 58. A plurality of capillary pipes 76*a* (small diameter portions) is disposed in the capillary pipe viscometer 76. The differential pressure sensor 70 is connected to upstream and downstream sides of the capillary pipes 76*a*. The concentration sensor 57*c* specifies a pressure difference between the upstream and downstream sides of the capillary pipes 76*a* using the differential pressure sensor 70, and measures a viscosity of the fluid (purge gas) flowing through the capillary pipe viscometer 76. By specifying the pressure difference between the upstream and downstream sides of the capillary pipes 76*a*, the viscosity of the fluid can be calculated using a Hagen-Poiseuille formula. The viscosity of the purge gas has a correlated relationship with the concentration of the purge gas. Due to this, the concentration of the purge gas can be specified by calculating the viscosity of the purge gas.

As above, the three types of concentration sensors 57 (57*a* to 57*c*) are described, however, the evaporated fuel processing device 20 may use a concentration sensor with another configuration including a small diameter portion. That is, a concentration sensor having a configuration of a small diameter portion through which the purge gas passes and with which a pressure changes before and after the passing according to the concentration of the purge gas (that is, the density or viscosity) and a sensor that can specify the pressure difference thereof may be used.

The A/F sensor 80 is disposed in the exhaust passage 36 of the engine 2. The A/F sensor 80 sends a signal corresponding to the A/F of the exhaust gas flowing in the exhaust passage 36 to the ECU 100. The ECU 100 specifies the A/F in the intake passage 34 from a specified result from the A/F sensor 80.

Figure 6:
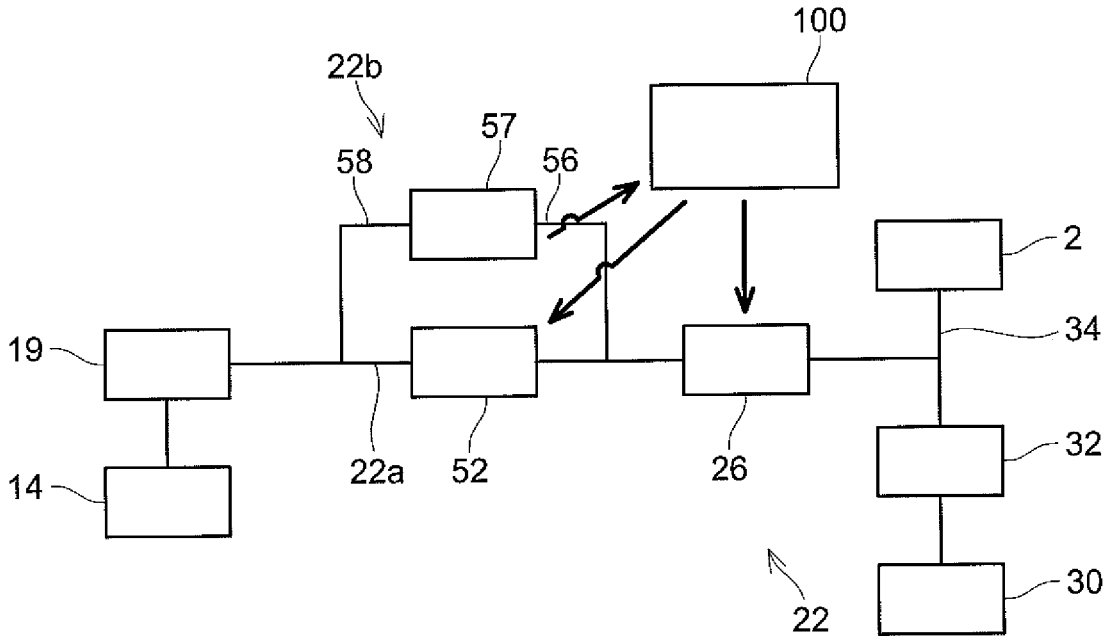
FIG. 6 shows an evaporated fuel supply system.
Figure 7:
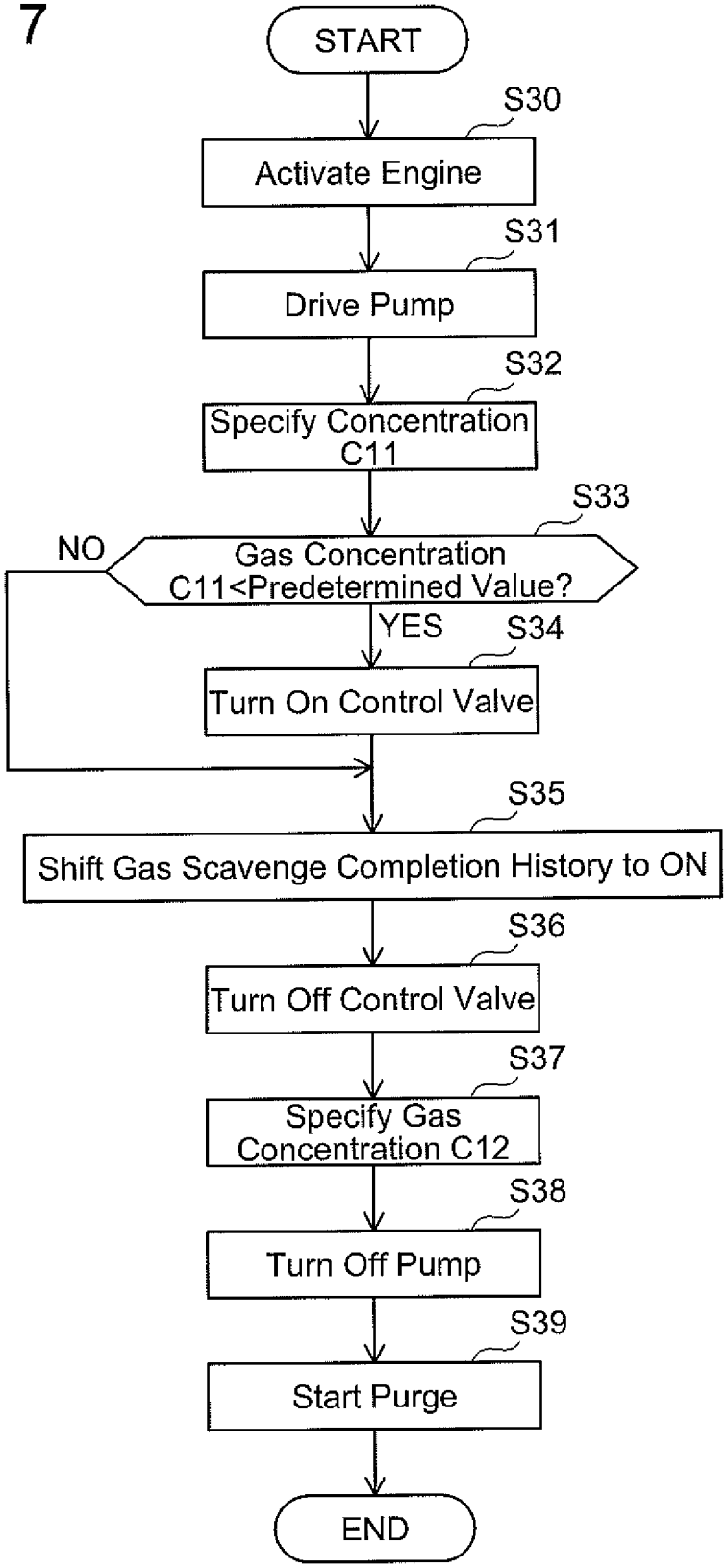
FIG. 7 shows a flowchart of a purge gas supply quantity adjusting method.

With reference to FIG. 6, an operation of the purge supply passage 22 during a process of supplying the purge gas to the intake passage 34 (hereafter termed "purge process") will be described. When the engine 2 is activated, the pump 52 starts to drive by being controlled by the ECU 100, and the control valve 26 is opened. The ECU 100 controls an output of the pump 52 and an aperture (or duty ratio) of the control valve 26 based on the concentration of the purge gas specified by the concentration sensor 57. The ECU 100 also controls an aperture of the throttle valve 32. The canister 19 has the evaporated fuel from the fuel tank 14 adsorbed therein. When the pump 52 is activated, the purge gas containing the evaporated fuel that was adsorbed in the canister 19 and the air that had passed through the air cleaner 30 are introduced to the engine 2.

A method of adjusting the purge gas supply quantity when the concentration of the purge gas changes during the purge process will be described with reference to FIGS. 7 to 10. The concentration sensor may be any one of the concentration sensors 57*a*, 57*b*, and 57*c*. In this method, prior to executing the purge process in the intake passage 34, a gas remaining in the purge passage (the purge gas that remained from when the previous purge process was terminated) is scavenged (that is, discharged to the intake passage 34). When the gas remaining in the purge passage is scavenged, the evaporated fuel that was adsorbed in the canister 19 is introduced into the purge passage. FIGS. 9 and 10 are timing charts showing timings to perform the purge process and on/off states of the pump 52 and the control valve 26. The pump 52 and the control valve 26 are controlled of their on/off states by control signals from the ECU 100.

A timing to shows a timing when the vehicle enters a state capable of traveling. For example, a time when the engine 2 is activated corresponds to the timing t0. At the timing t0, the gas is remaining in the purge passage and the ECU 100 has information stored therein indicating that the gas in the purge passage has not been scavenged. At the timing t0, the ECU 100 has information stored therein indicating that a gas scavenge completion history is in an OFF state. At the timing t0, the pump 52 and the control valve 26 are in the off states. When the engine 2 is activated (S30), the ECU 100 drives the pump 52 with the control valve 26 in the off state (S31: timing t1). The ECU 100 measures a gas concentration between a timing t1 and a timing t2 while the control valve 26 is off (S32). Specifically, the ECU 100 calculates the gas concentration by using the differential pressure of the purge gas passing through the small diameter portion of the concentration sensor 57 and the flow rate calculated from the rotary speed of the pump 52. A database indicating a relationship between the rotary speed of the pump 52 and the flow rate is specified in advance by experiments, and is stored in the ECU 100. This database is specified by the experiments using one or some pumps 52 selected from among plural pumps 52 upon manufacture, so an individual difference in performances of the plural pumps 52 is not taken into consideration.

In a case where a purge gas concentration C11 specified in S32 is leaner than a predetermined value (S33: YES), the ECU 100 proceeds to S34 and turns on the control valve 26 for a predetermined time period while maintaining the pump 52 in the on state (timings t2 to t3). Due to this, the gas that was remaining in the purge supply passage 22 (purge gas that remained from when the previous purge process was terminated) can be scavenged from within the purge supply passage 22. The ECU 100 decides the period for turning on the control valve 26 (timings t2 to t3) based on the purge gas concentration C11 specified during the timings t1 to t2. Due to this, the A/F can be suppressed from being disturbed greatly by the purge gas scavenged to the intake passage 34.

When the scavenging of the remaining gas is completed (that is, when the period for turning on the control valve 26 elapses), the ECU 100 shifts the gas scavenge completion history to an ON state (S35, timing t3). The gas scavenge completion history maintains the ON state during when the engine 2 is driving. Further, after the scavenging of the remaining gas is completed, the ECU 100 turns off the control valve 26 while maintaining the pump 52 to be driven (836, timing t3). After this, the ECU 100 specifies a purge gas concentration C12 in the purge passage (S37). After having specified the purge gas concentration C12, the ECU 100 turns off the pump 52 (S38, timing t4). A value of the purge gas concentration C12 specified between the timings t3 to t4 is used when the ECU 100 outputs a purge-ON signal (when the purge process is actually started: S39, timing t5). That is, upon starting the purge process, the aperture of the control valve 26 and the output of the pump 52 are decided based on the value of the gas concentration C12.

In a case where the concentration C11 of the purge gas in the purge passage is richer than the predetermined value in S33 (S33: NO), the control valve 26 is not turned on at the timing t2 as shown in FIG. 10 (that is, S34 is skipped). At this occasion, the scavenging in the purge passage is actually not finished yet, however, the process proceeds to S35 and the gas scavenge completion history is set to the ON state. In this case, upon when the purge process is to be actually started (timing t5), the aperture of the control valve 26 and the output of the pump 52 are decided based on the value of the gas concentration C12. In a case where the gas concentration in the purge passage (concentration of the remaining gas) is rich, the A/F tends to become rich when this gas is scavenged to the intake passage 34. In this case, nitrogen oxides tend to be generated in the exhaust gas. Due to this, in the case where the concentration of the remaining gas in the purge passage is richer than the predetermined value, the scavenging of the purge passage is not performed, and the aperture of the control valve 26 and the output of the pump 52 are decided based on the gas concentration C12. Due to this, the A/F is adjusted to match the reference value.

During the purge process, the ECU 100 estimates the gas concentration using the A/F specified by the A/F sensor 80. Specifically, in a case where the A/F during the purge process is leaner than the reference value, the gas concentration is estimated by subtracting a predetermined value from the gas concentration measured before the purge process was started (for example, gas concentrations C12, C13). On the other hand, in a case where the A/F during the purge process is richer than the reference value, the gas concentration is estimated by adding the predetermined value to the gas concentration measured before the purge process was started (for example, gas concentrations C12, C13). The fuel injection quantity, the aperture of the throttle valve 32 (that is, air quantity), and the flow rate of the purge gas are adjusted so that the A/F matches the reference value during the purge process. In the case where the A/F is leaner than the reference value under this situation, the current gas concentration is estimated as being decreased than the gas concentration at the time when the fuel injection quantity, the aperture of the throttle valve 32, and the flow rate of the purge gas were decided. Due to this, the new gas concentration is estimated by subtracting to the current gas concentration. On the other hand, in the case where the A/F is richer than the reference value, the current gas concentration is estimated as being increased than the gas concentration at the time when the fuel injection quantity, the aperture of the throttle valve 32, and the flow rate of the purge gas were decided. Due to this, the new gas concentration is estimated by adding to the current gas concentration. When the new gas concentration is estimated, the ECU 100 adjusts the fuel injection quantity, the aperture of the throttle valve 32 (that is, the air quantity), and the flow rate of the purge gas so that the A/F matches the reference value.

Figure 8:
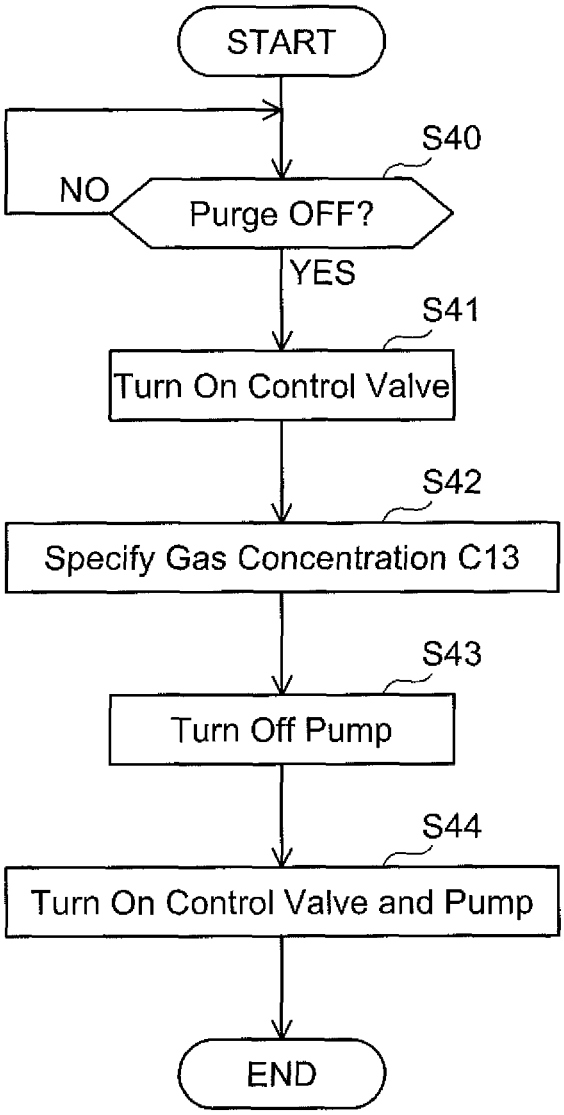
FIG. 8 shows a flowchart of the purge gas supply quantity adjusting method.
Figure 9:
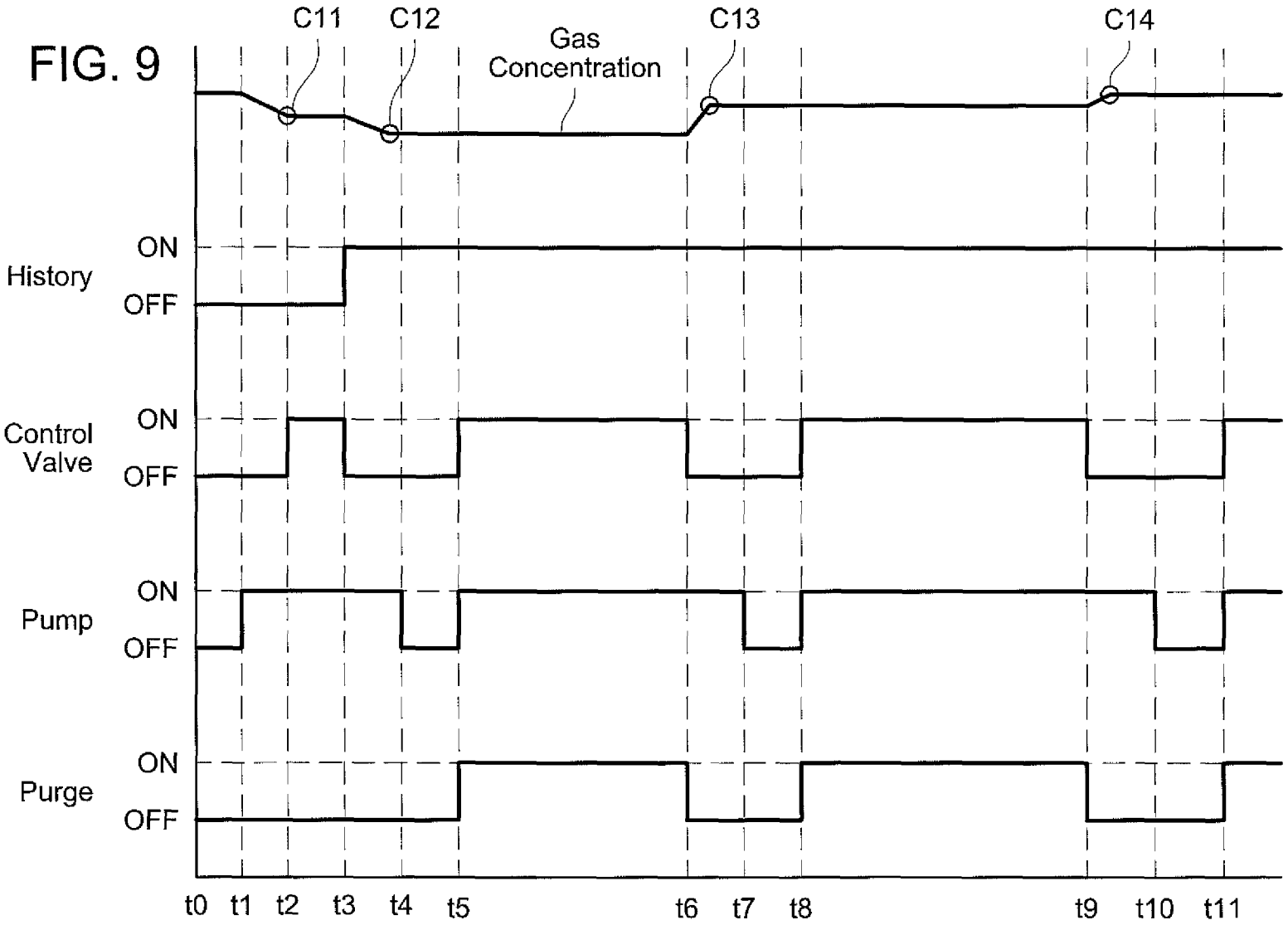
FIG. 9 shows a timing chart of a purge gas supply quantity adjusting process.
Figure 10:
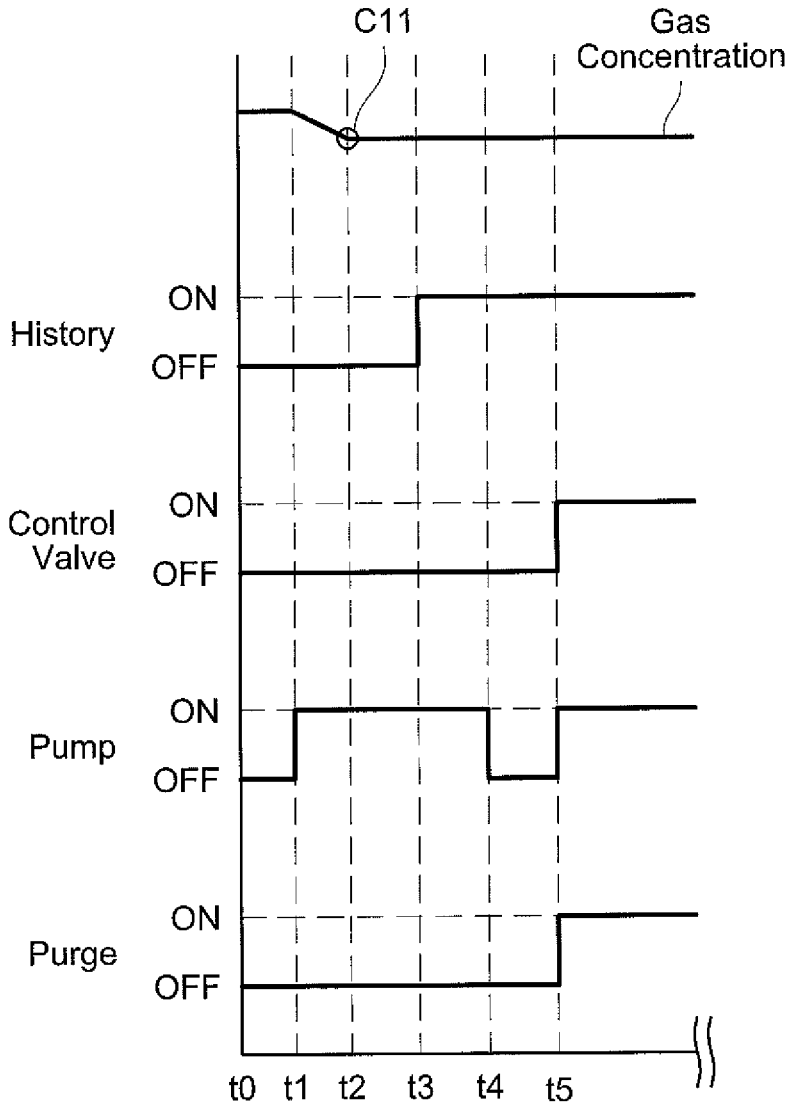
FIG. 10 shows a timing chart of the purge gas supply quantity adjusting process.

FIG. 8 shows the purge gas supply quantity adjusting method from the timing t5 and thereafter in FIG. 9. When the purge process is started at the timing t5, the pump 52 is driven, the control valve 26 is turned on (opens and closes), and the purge gas is supplied to the intake passage 34 during timings t5 to t6. In step S40, a determination is made on whether or not a purge-OFF signal is outputted at the timing t5 or thereafter. In a case where the purge-OFF signal is outputted (S40: YES), the control valve 26 is turned off (S41, timing t6). At the timing t6, the pump 52 is maintained to be driving (timings t6 to t7). The gas concentration C13 in the purge passage is specified during the timings t6 to t7 (S42). After specifying the gas concentration C13, the pump is turned off (S43, timing t7). After this, when the purge-ON signal is outputted (timing t8), the control valve 26 is turned on, and the pump 52 is turned on (S44).

During timings t8 to t9, the aperture of the control valve 26 and the output of the pump 52 are decided based on the gas concentration C13. During timings t9 to t11, same operations as those during the timings t6 to t8 are performed. That is, the pump 52 is driven for the predetermined time (t9 to t10) in the state where the purge is off (t9 to t11), and a gas concentration C14 is specified.

The above method specifies the concentration of the purge gas in the state of the purge being off (control valve being closed), and the aperture (duty ratio) of the control valve 26 and the output of the pump 52 for the state where the purge is executed are controlled based on this gas concentration. Since the concentration of the purge gas is known upon starting the purge process, the purge gas supply quantity can be adjusted more accurately. Further, since the purge passage 22*a* is scavenged between the activation of the engine 2 and the start of the purge process, by the time when the purge process is started, the concentration of the purge gas supplied from the canister 19 can effectively be reflected on the purge supply quantity. Further, upon scavenging the purge passage 22*a*, the concentration of the purge gas remaining in the purge passage 22*a* is specified before the scavenge, so the A/F can be prevented from being disturbed greatly upon scavenging.

As described above, during when the purge process is not executed, that is, during when the purge gas is circulating through the purge passage 22*a* and the branch passage 22*b*, the gas concentration can be specified using the concentration sensor 57. On the other hand, during the purge process, the gas concentration can be estimated using the A/F sensor 80.

Figure 11:
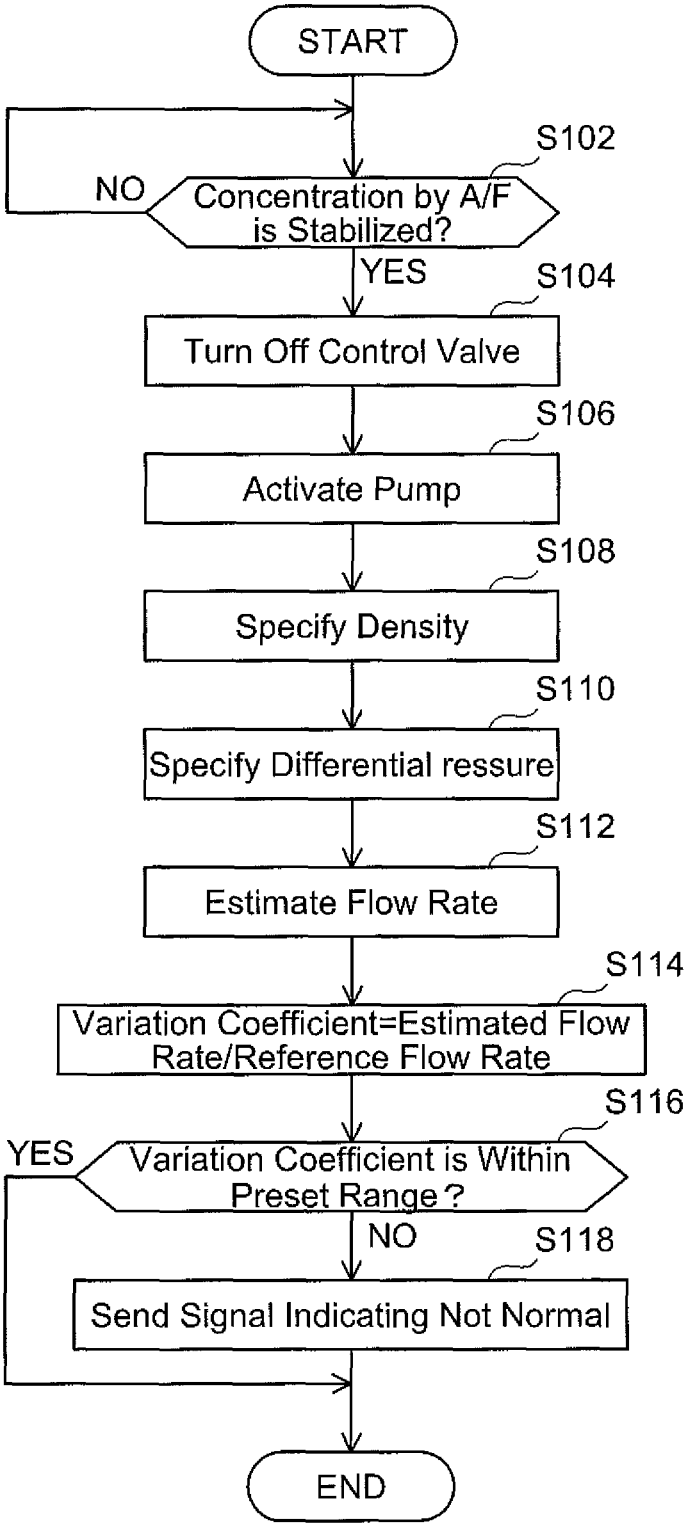
FIG. 11 shows a flowchart of the purge gas supply quantity adjusting method.

Next, a determination process that determines whether or not the pump 52 is operating normally or not will be described with reference to FIG. 11. The pump 52 is controlled by the ECU 100. The ECU 100 controls the rotary speed of the pump 52 according to the signal supplied to the pump 52. However, there are eases where the pump 52 cannot rotate normally according to the supplied signal due to deterioration or wire disconnection in the pump 52, for example. In such cases, the purge gas at the expected flow rate cannot be supplied, and it becomes difficult to suitably control the air-fuel ratio. Further, the flow rate relative to the rotary speed of the pump 52 changes according to the density (that is, the concentration) of the purge gas. Further, the flow rate relative to the rotary speed of the pump 52 differs depending on the individual difference such as a dimensional difference in the pump 52. In the determination process, a variation coefficient indicating the variation of the flow rate caused by the individual difference in the pump 52 and the density of the purge gas is calculated.

The determination process is executed regularly or irregularly during the purge process while the purge process is being executed. In the determination process, firstly, the ECU 100 determines whether or not the gas concentration estimated from the detection result of the A/F sensor 80 has been stabilized (S102). Specifically, the ECU 100 determines whether or not the A/F specified by the A/F sensor 80 while the purge process is being executed has stabilized at the reference value. When the gas concentration by the A/F sensor 80 is stabilized (S102: YES), the ECU 100 turns off the control valve 26 and switches the purge passage 22*a* and the intake passage 34 from a communication state to a non-communication state (S104). Then, the ECU 100 supplies a signal for causing the pump 52 to rotate at the predetermined rotary speed to the pump 52 (S106). In a case where the pump 52 has already received the signal for causing it to rotate at the predetermined rotary speed, the process of S106 is skipped. Due to this, the purge gas circulates in the purge passage 22*a* and the branch passage 22*b* (see the arrow 62 in FIG. 2).

In a case where the pump 52 is operating normally, the pump 52 rotates at the predetermined rotary speed±error value. The error value is an error within a tolerance which differs for each pump 52 due to the dimensional difference of the pump 52. Next, the ECU 100 uses the gas concentration obtained by using the detection result of the A/F sensor 80 and a database indicating a relationship between the gas concentration and the purge gas density to specify the density of the purge gas (S108). This database is created in advance by experiments using plural purge gases having different gas concentrations, and is stored in the ECU 100.

Next, the ECU 100 uses the concentration sensor 57 to specify the differential pressure of the purge gas (S110). Then, the ECU 100 uses the density specified in S108 and the pressure difference specified in S110 to estimate the flow rate of the purge gas (S112). Specifically, the ECU 100 stores a database indicating a relationship between the density of the purge gas and the pressure difference of the purge gas and the flow rate of the purge gas. This database is created in advance by experiments using plural purge gases having different gas concentrations (that is, densities) and changing flow rates of the purge gases, and is stored in the ECU 100. When the gas concentration changes, the density of the purge gas changes. The flow rate is greater for a higher density, and the flow rate is greater for a greater pressure difference. The ECU 100 estimates the flow rate of the purge gas from the density specified in S108, the pressure difference specified in S110, and the database.

Next, the ECU 100 calculates the variation coefficient by dividing the flow rate of the purge gas estimated in S112 by a reference flow rate for a case where the pump 52 is operating at the predetermined rotary speed (S114). The reference flow rate is a flow rate for example of a case where the pump 52 is driven at the predetermined rotary speed to flow the purge gas in a predetermined concentration (that is, density, which is for example 5%). The reference flow rate is specified in advance by experiments, and is stored in the ECU 100.

Next, the ECU 100 determines whether or not the variation coefficient is within a preset normal range (for example, 0.5 to 1.5) (S116). The normal range is stored in the ECU 100 in advance. In a case where the variation coefficient is determined as not being in the normal range (S116: NO), a signal indicating that the pump 52 is not operating normally is sent to a display device of the vehicle (S118), and the normality determination process is terminated. As a result, the display device performs a display indicating that the pump 52 is not operating normally. Due to this a driver can acknowledge that the pump 52 is not operating normally. On the other hand, in a case where the variation coefficient is determined as being in the normal range (S116: YES), S118 is skipped and the normality determination process is terminated. In the case where the variation coefficient is in the normal range, it is determined that a variation in the flow rate by the pump 52 is within an allowable range. Now in the case of having determined YES in S116, the ECU 100 switches the control valve 26 to the on state to execute the purge process after terminating the determination process. On the other hand, in the case of having determined NO in S116, the ECU 100 stops the pump 52 and does not execute the purge process.

The ECU 100 stores the variation coefficient calculated in S114. The ECU 100 cyclically calculates the purge flow rate per unit time while executing the purge process to adjust the fuel injection time period. At this occasion, the ECU 100 multiplies the variation coefficient by the flow rate of the purge gas estimated from the rotary speed of the pump 52 to calculate the estimated flow rate of the purge gas. Due to this, the flow rate obtained by taking the variation of the pump 52 and the variation by the gas concentration into consideration can be estimated.

Second Embodiment

Figure 12:
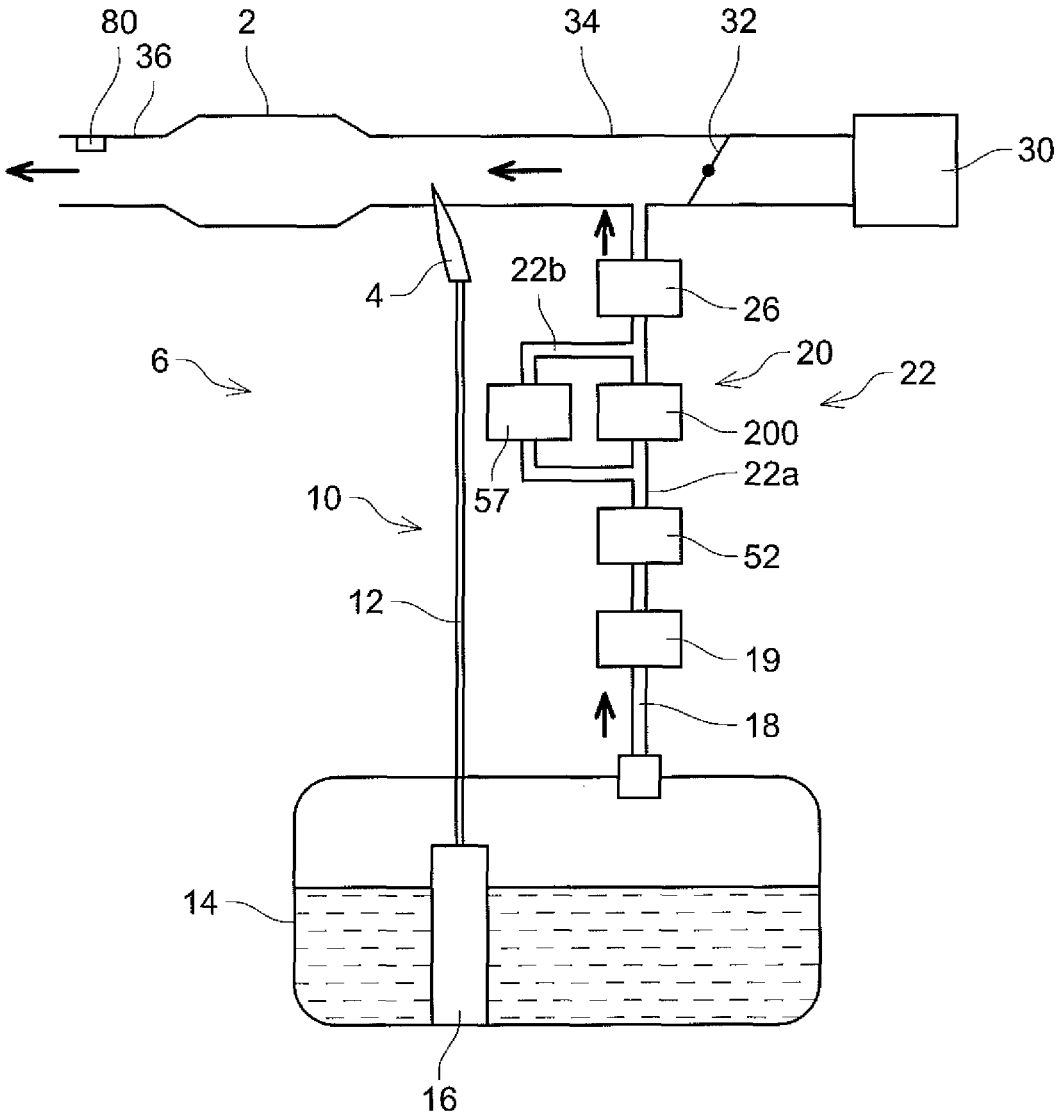
FIG. 12 shows a fuel supply system of a vehicle using an evaporated fuel processing device according to a second embodiment.

Points that differ from those of the first embodiment will be described with reference to FIG. 12. In the evaporated fuel processing device 20 of the present embodiment, the pump 52 is disposed on the purge passage 22*a* between the canister 19 and the branch passage 22*b*. Further, a cutoff valve 200 is disposed on the purge passage 22*a* that is parallel to the branch passage 22*b*. The cutoff valve 200 switches between a state of opening the purge passage 22*a* (off) and a state of closing the purge passage 22*a* (on) in accordance with a signal from the ECU 100. During the purge process, the cutoff valve 200 is maintained in the state of opening the purge passage 22*a* so that the purge gas can be supplied to the intake passage 34 without intervening through the concentration sensor 57. When the cutoff valve 200 is switched from off to on during the purge process to be in the state of dosing the purge passage 22*a*, the purge gas is supplied to the intake passage 34 from the purge passage 22*a* through the branch passage 22*b*. Due to this, in the evaporated fuel processing device 20 of the present embodiment, the gas concentration can be specified using the concentration sensor 57 during the purge process. Further, in the determination process, instead of switching the control valve 26 to off in S104, the cutoff valve 200 can be switched from off to on to execute the determination without switching the control valve 26 to off. Specifically, instead of executing the process of S104 in FIG. 11, the cutoff valve 200 is switched from off to on.

Third Embodiment

Figure 13:
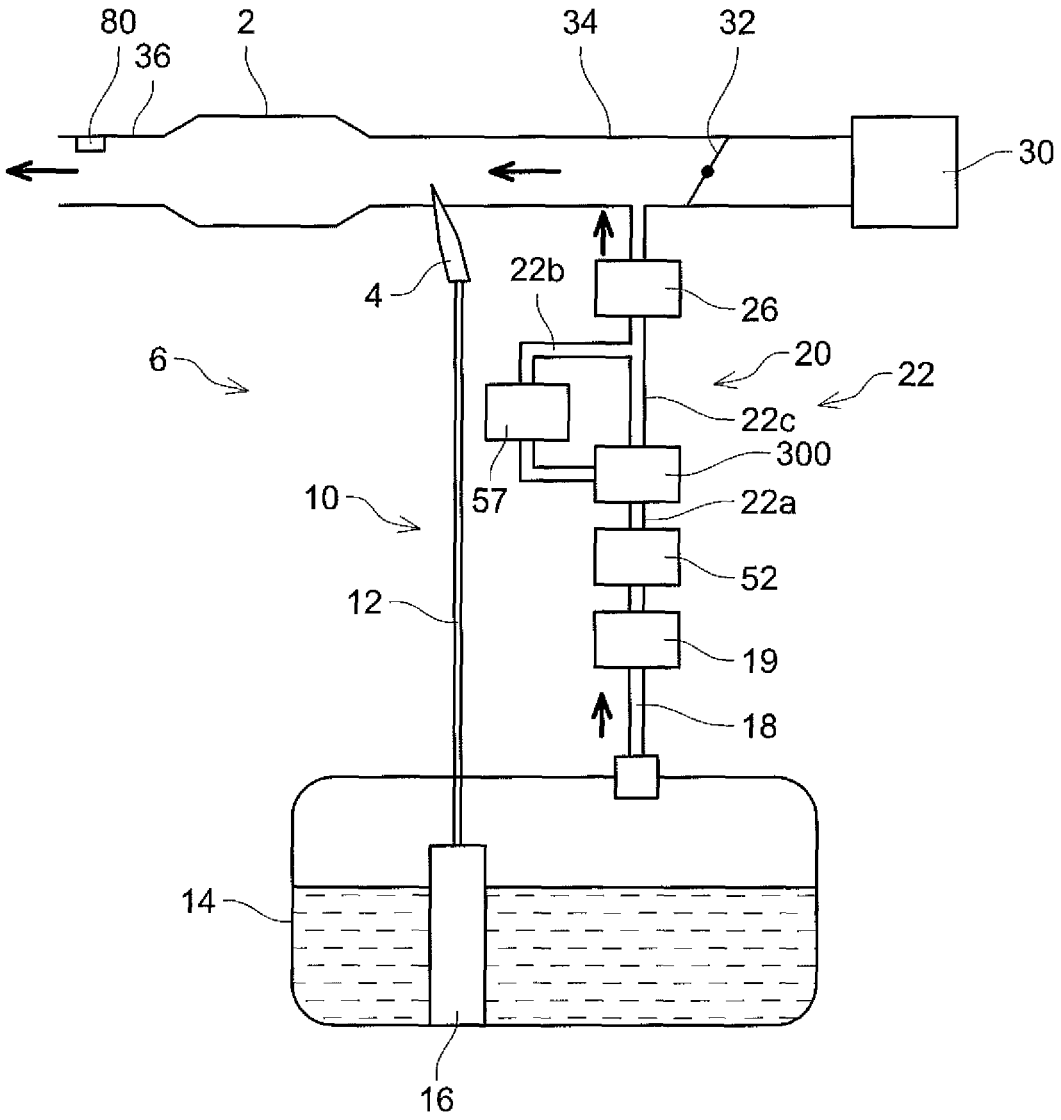
FIG. 13 shows a fuel supply system of a vehicle using an evaporated fuel processing device according to a third embodiment.

Points that differ from those of the first embodiment will be described with reference to FIG. 13. In the evaporated fuel processing device 20 of the present embodiment, the pump 52 is disposed on the purge passage 22*a* between the canister 19 and the branch passage 22*b*, similar to the second embodiment. Further, a switch valve 300 is disposed at a branching position of the branch passage 22*b* and the purge passage 22*a*. The switch valve 300 switches between a first state in which the pump 52 is communicated with the purge passage 22*c* that is parallel to the branch passage 22*b* while it is cut off from the branch passage 22*b*, and a second state in which the pump 52 is communicated with the branch passage 22*b* while it is cut off from the purge passage 22*c*. During the purge process, the switch valve 300 is maintained in the first state and the purge gas can be supplied to the intake passage 34 without intervening through the concentration sensor 57. When the switch valve 300 is switched from the first state to the second state during the purge process, the purge gas is supplied to the intake passage 34 from the purge passage 22*a* through the branch passage 22*b*. Due to this, in the evaporated fuel processing device 20 of the present embodiment, the gas concentration can be specified using the concentration sensor 57 during the purge process. In this configuration, similar to the second embodiment, in the determination process, instead of switching the control valve 26 to off in S104, the switch valve 300 can be switched from the first state to the second state to determine whether or not the pump 52 is normal.

As above, the embodiments of the present invention have been described, however, these are merely examples, and do not intend to limit the scope of claims. The techniques described in the scope of claims include various alterations and variants of the embodiments described above. Further, the technical features described in the description and the drawings may technically be useful alone or in various combinations, and are not limited to the combinations as originally claimed. Further, the technique described in the description and the drawings may concurrently achieve a plurality of aims, and technical significance thereof resides in achieving any one of such aims.

DESCRIPTION OF REFERENCE NUMBERS

2: Engine
6: Fuel Supply System
12: Supply Passage
14: Fuel Tank
15: Air Filter
16: Fuel Pump Unit
17: Communicating Passage
18: Communicating Passage
20: Evaporated Fuel Processing Device
22: Purge Supply Passage
25: Pump
26: Control Valve
32: Throttle Valve
34: Intake Passage
36: Exhaust Passage
52: Pump
56: First Branch Pipe
57: Concentration Sensor
80: Air-Fuel Ratio Sensor

The invention claimed is:

1. An evaporated fuel processing device mounted on a vehicle, the evaporated fuel processing device comprising:

a canister configured to adsorb fuel evaporated in a fuel tank;

a purge passage connected between the canister and an intake passage of an engine, and through which a purge gas sent from the canister to the intake passage passes;

a pump configured to send the purge gas from the canister to the intake passage;

a control valve disposed on the purge passage and configured to switch between a communication state and a cutoff state, the communication state being a state where the canister and the intake passage communicate through the purge passage, and the cutoff state being a state where the canister and the intake passage are cut off on the purge passage;

a branch passage branching from the purge passage at an upstream end of the branch passage and joining the purge passage at a downstream end of the branch passage, the downstream end of the branch passage being located at different position from the upstream end of the branch passage;

a pressure specifying unit comprising a small diameter portion disposed on the branch passage and through which the purge gas in the branch passage passes, and configured to specify a pressure difference of the purge gas passing through the small diameter portion between an upstream side and a downstream side of the small diameter portion;

an air-fuel ratio sensor disposed on an exhaust passage of the engine; and an estimation unit configured to estimate a first flow rate of the purge gas sent from the pump by using an evaporated fuel concentration in the purge gas that is estimated using an air-fuel ratio acquired from the air-fuel ratio sensor and the pressure difference specified by the pressure specifying unit.

2. The evaporated fuel processing device as in claim 1, wherein the estimation unit is configured to:

estimate a second flow rate of the purge gas sent from the pump by using a rotary speed of the pump; and calculate a value related to a variation of a flow rate of the pump by using the first flow rate and the second flow rate.

3. The evaporated fuel processing device as in claim 2, further comprising:

a determination unit configured to determine whether the pump operates normally or not by using the value related to the variation of the flow rate.

4. The evaporated fuel processing device as in claim 2, wherein the estimation unit is configured to correct the second flow rate by using the value related to the variation of the flow rate so as to estimate a corrected second flow rate of the purge gas sent from the pump.

* * * * *